United States Patent [19]

Schultes

[11] 4,030,514

[45] June 21, 1977

[54] SHORTENABLE UMBRELLA

[75] Inventor: Tilmann Schultes, Solingen-Weyer, Germany

[73] Assignee: Kortenbach & Rauh Kommanditgesellschaft, Solingen, Germany

[22] Filed: July 26, 1976

[21] Appl. No.: 708,996

[30] Foreign Application Priority Data

Aug. 9, 1975 Germany ..... 2535634

[52] U.S. Cl. ..... 135/25 R; 135/25 A; 135/27; 135/75

[51] Int. Cl.[2] ..... A45B 19/04

[58] Field of Search ..... 135/25 A, 25 R, 26, 135/27, 75

[56] References Cited

UNITED STATES PATENTS

| | | | |
|---|---|---|---|
| 1,249,007 | 12/1917 | Block | 135/25 R |
| 2,649,103 | 8/1953 | Militano | 135/25 R |
| 3,893,467 | 7/1975 | Winger | 135/25 R |
| 3,902,514 | 9/1975 | Weber | 135/25 R |
| 3,921,655 | 11/1975 | Weber | 135/25 R |

*Primary Examiner*—Werner H. Schroeder
*Assistant Examiner*—Conrad L. Berman
*Attorney, Agent, or Firm*—Martin A. Farber

[57] ABSTRACT

A shortenable umbrella with blades carrying the umbrella canopy in opened condition, the blades being shortenable at least by a factor of two by telescoping or folding, of which the innermost blade part is pivoted on a crown secured on the shortenable rod and are pivotable by means of at least one fork by means of at least one slider, whereby the outermost blade part is hinged foldable on the adjacent blade part by means of a control rod which acts on an extension of the outermost blade part. The umbrella is characterized in that the inner end of the control rod engaging directly and positively without friction or slipping on the outermost blade part is pivotably fastened to a slide hinge, which slide hinge is displaceably disposed on the middle blade part in the vicinity of the middle hinge and is articulated play-free on the fork by means of a short connecting rod. The latter is as little as possible longer than the distance between its pivot point on the fork and the pivot point of the fork on the associated corresponding blade part.

3 Claims, 4 Drawing Figures

SHORTENABLE UMBRELLA

In general this invention relates to a shortenable umbrella.

The invention relates to a shortenable umbrella with blades carrying the umbrella canopy in opened condition, the blades being shortenable at least by a factor of two by telescoping or folding, of which the innermost blade part is pivoted on a crown secured on the shortenable rod and are pivotable by means of at least one fork by means of at least one slider, whereby the outermost blade part is hinged foldable on the adjacent blade part by means of a control rod which acts on an extension of the outermost blade part, in particular.

Shortenable or contractable umbrellas of the previously mentioned type are known with telescopic canopy rod ribs or blades as well as with scissors like joint folding or collapsible frame blades. With both designs the folded down blade parts have a tendency during the opening of the umbrella to fold back into the folded position, whereby the outer ring of the umbrella canopy is folded up. This is suppressed with the known designs either by resilient or springy intermediate elements or by an elongated hole or slot connection, which however increases in part the folding-down movement, the latter which is caused by the control rod. While the design provided with an elongated hole connection consequently has the disadvantage that the folding movement of the outermost blade parts are only imperfectly controlled, with the design having the resilient intermediate elements there exists the disadvantage that it is expensive in production as well as during assembly and beyond that it is particularly susceptible to trouble or failure to a marked degree.

It is an object of the present invention starting out from the known state of the art of the introductory mentioned type to provide an umbrella with a structure which effects a positive forcefull constrained folding down of the outermost blade parts without the use of resilient intermediate elements.

This task is aided in its solution in accordance with another object of the present invention in that the inner end of the control rod 12 engaging directly and positively without friction or slipping on the outermost blade part 10 further is pivotably fastened to a slide hinge 13, which slide hinge is displaceably disposed on the middle blade part 7 in the vicinity of the middle hinge 8 and is articulated on the fork 5 play-free by means of a short connecting rod 14, the latter being as little as possible longer than the distance between its pivot point on the fork 5 and the pivot point of the fork 5 on the associated corresponding blade part 7, by means of rigid connections an early folding down of the outermost blade parts being achieved, and thereby the outer umbrella canopy ring is prevented from folding back. These advantages are achieved in the manner that during the opening of the umbrella, when the fork stands substantially perpendicularly to the middle blade part, the short connecting rod causes a shortening of the control members, the latter which comprise altogether the control rod and the connecting rod, whereby the foldable outermost blade part is folded down very early and consequently a folding back is prevented during the opening operation. With the structural formation in accordance with the present invention, consequently, there is achieved in spite of a uniform movement of the slider, a folding down movement of the outermost blade parts, which fold down movement is accelerated at a decisive critical moment, and indeed by means of a control movement without any costly and trouble-susceptible elements, is automatically brought about by positive cooperating parts acting without friction or slipping.

With one preferred advantageous embodiment of the shortenable umbrella in accordance with the present invention, the innermost blade part is formed by a scissors fork 4 which is pivoted between the crown 2 and the fork 5 and by a stretch segment fork 11, the latter being pivoted between the scissors fork 4 and a center hinge 8, the latter being secured to the inner end of the middle blade part 7, so that altogether a so called scissors (joint) umbrella results, which not only during the opening of the umbrella automatically stretches or spreads out the umbrella canopy, but rather also, during the closing of the umbrella, an automatic folding together of tkhe umbrella frame with simultaneously folding of the umbrella canopy is effected, whereby after the folding together of the umbrella canopy, the preferably telescopic rod assembly is shortened by a manual movement lying in the direction of movement of the slider.

With the above and other objects and advantages in view, the present invention will become more clearly understood from the following detailed description of a preferred embodiment of the present invention, in connection with the accompanying drawings, of which:

Figure 1:
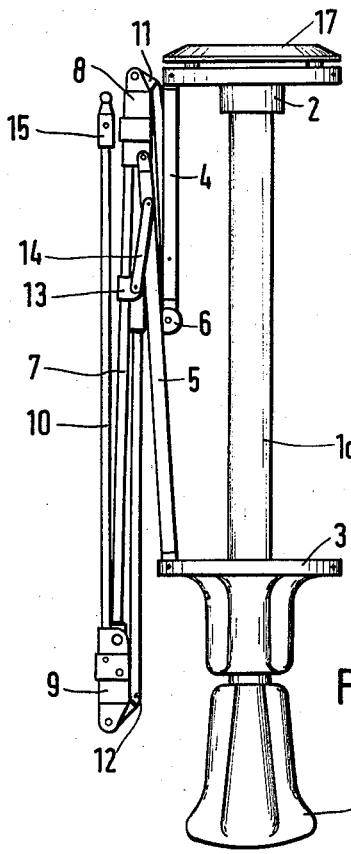
FIG. 1 is a front view of an umbrella frame in accordance with the present invention illustrated in closed condition, whereby for better clarity of view only one complete frame cage rib part of the totally eight ribs is illustrated.

The illustrated embodiment example relates to a so-called flat umbrella with a crown having an oval or oblong cross section, an oblong oval slider and an oval handle. Of course, the umbrella can also be equipped with round crowns, as well as round sliders and round handles. Further, it is possible, moreover, to produce the umbrella in a so-called self opening design, in which the slider and auxiliary slider are coordinated in the manner that between the sliders there are arranged an opening spring and the auxiliary slider is connected over auxiliary struts with the fork and the main slider.

Referring now to the drawings, in accordance with the illustrated embodiment example of the present invention, the shortenable or collapsible umbrella, includes a central rod assembly which comprises an outer tube 1*a*, a center tube 1*b*, and an inner tube 1*c*, which are telescopicaly guided within each other. A crown 2 is fastened to the free end of the outer tube 1*a* and a slider 3 is moveably arranged on the outer tube 1*a*. Between the crown 2 and the slider 3, in accordance with the illustrated embodiment, there are provided eight equally formed frame cage ribs which carry the umbrella canopy in tension, which frame cage ribs are designated altogether as blades. For a better view of illustration of these blades only respectively, one is illustrated, which is shortenable by a factor of three.

This triple-shortenable blade comprises a scissors jointed fork 4 which is pivoted with one end on the corwn 2; its other end is pivotally fastened by means of a hinge assembly 6 on a fork 5. This fork 5 extends between the slider 3 and a middle hinge 8, the latter being fastened on a middle or center blade part 7. A flap or folding hinge 9 is pivoted on the outer end of the middle blade part 7l, to which hinge 9 there is secured a foldable collapsibly hinged outermost blade part 10. The middle or center hinge 8 which is secured on the middle blade part 7 projects inwardly beyond, over the pivot point of the fork 5 on the blade part 7. A stretch segment fork 11 is pivoted onto this over projecting end of the middle hinge 8, the segment fork 11 being pivotally fastened with its inner end on the scissors fork 4.

Also, the folding hinge 9, which is secured on the outermost blade part 10, projects with an extension inwardly over the pivot point of the outermost blade part 10 on the center blade part 7. Onto this extension there is pivoted the outer end of a control rod 12, the latter lying in one plane with the rod 1 and the middle blade part 7. The inner end of this control rod 12 is pivotably fastened on a slide hinge 13 which is displaceably arranged on the middle blade part 7. This slide hinge 13 is connected by means of a connecting rod 14 with the fork 5. The connecting rod 14 lies laterally on the sides of the control rod 12 and the fork 5 so that it does not hinder or prevent their movements.

On the outer ends of the blade parts 10, respectively, a pole top end 15 is secured thereto. On this pole top end 15, the edge of an umbrella cover 16 is fastened which is secured in the middle on the crown 2 by a so-called top or cap 17. Therebetween there is at least one further fixing of the umbrella cover 16 onto the umbrella frame cage, and indeed by loops 18 which grip engagingly-through by an opening provided therefor in the folding hinge 9. Further in FIGS. 1 and 2, a handle 19 is illustrated which is secured on the lower end of the inner tube 1*c*.

Figure 2:
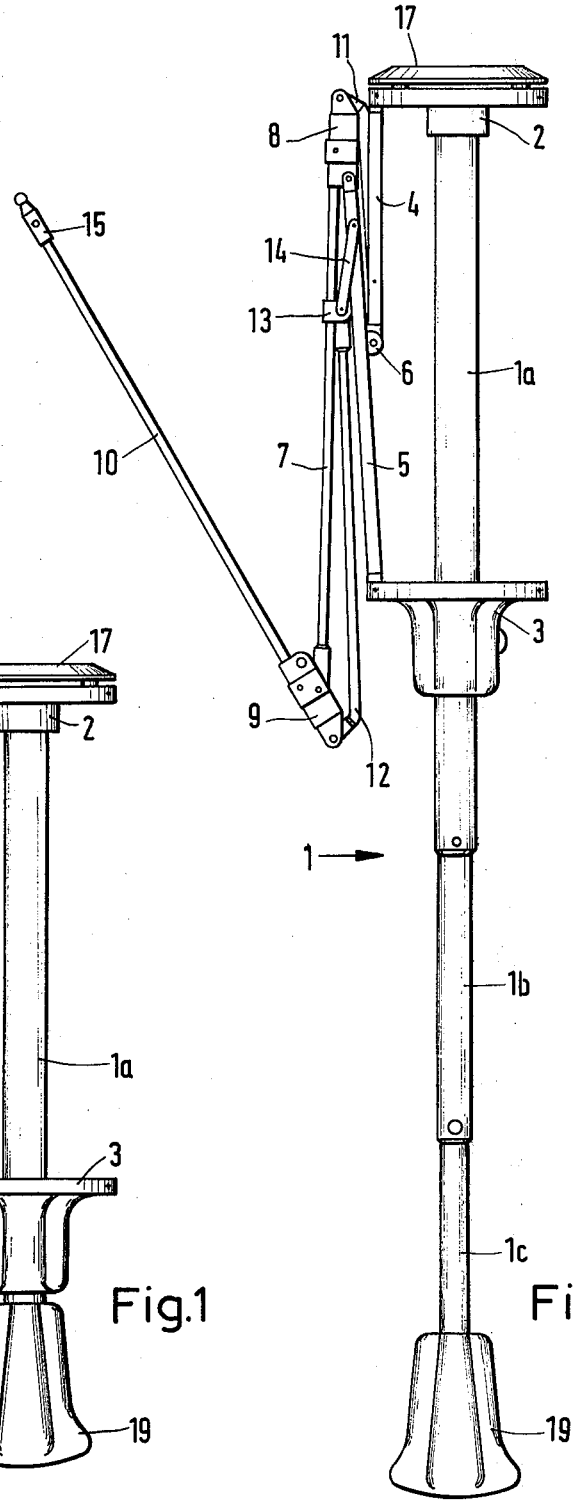
FIG. 2 is a view similar to FIG. 1 however with the rod pulled out at the beginning of the opening movement.
Figure 3:
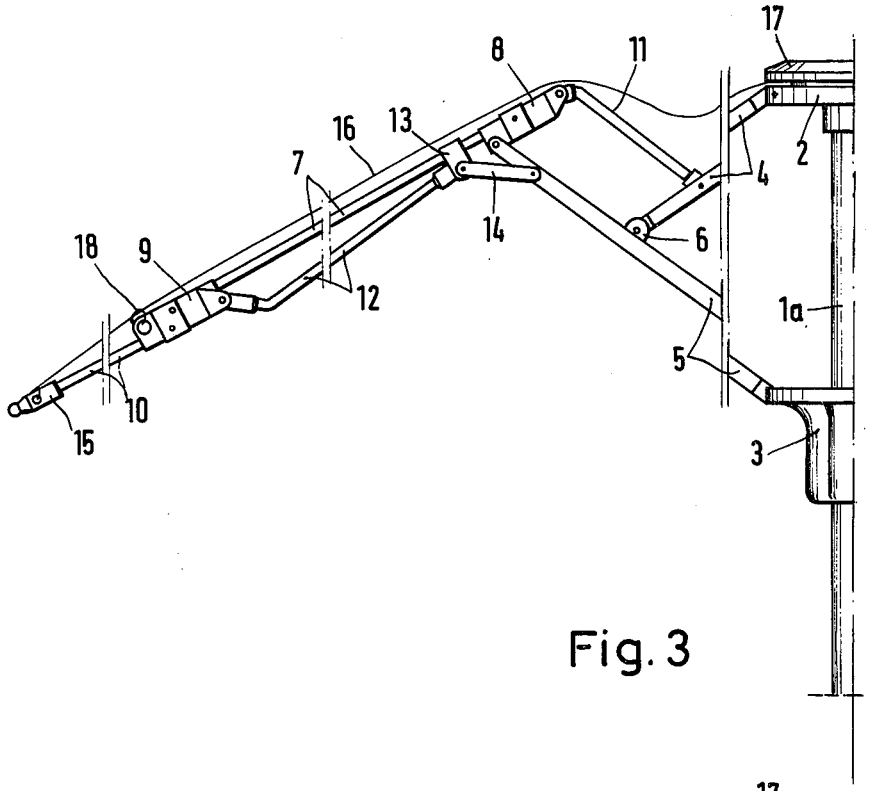
FIG. 3 is a further elevation view similar to the previous views showing the illustrated umbrella frame during the opening movement, and being partially broken away.
Figure 4:
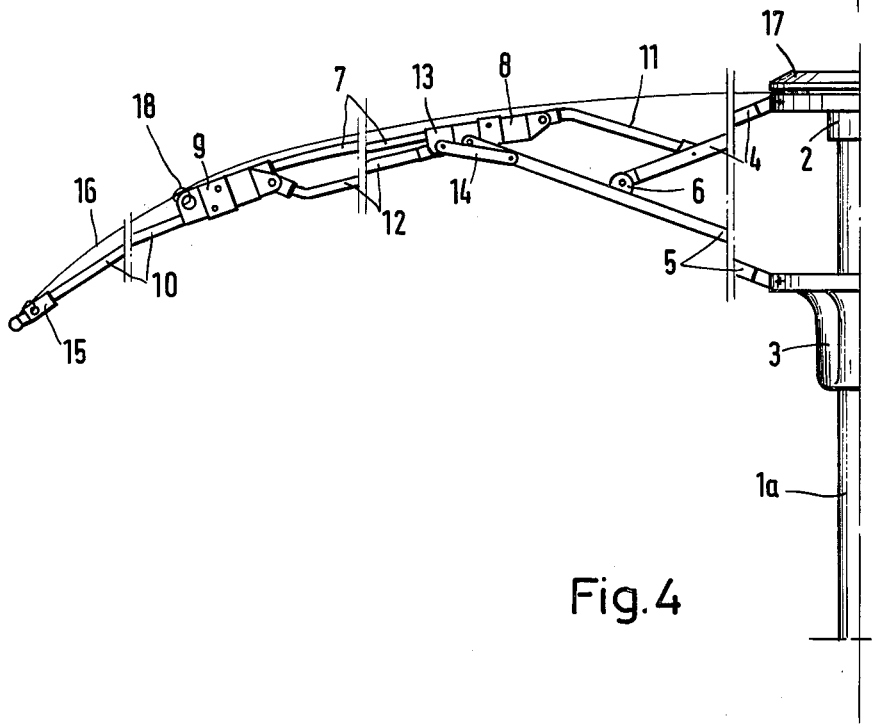
FIG. 4 is a similar view of the umbrella shown in the opened position and partly broken away.

For opening of the folded umbrella according to FIG. 1, the rod assembly 1 is pulled out and in the slider 3 is shifted on the outer tube 1*a* in a diecton toward the crown 2. By this action, the cener blade part 7 is swung out (from its position according to FIG. 1 running parallel to the rod 1) and is spread or widened by means of the scissors fork 4, the fork 5 and the stretch segment fork 11. In order by this opening movement of the umbrella canopy to achieve an opening or unfolding of the annular shaped outer part of the umbrella cover, which part is fastened on the blade parts 10, these blade parts 10 are forcefully opened or unfolded. This unfolding or opening occurs by means of the conrol rod 12 which, in the closed position of the umbrella according to FIG. 1, lies substantially in one line with the connecting rod 14. Already at the beginning of the opening movement, the connecting rods 14 cause the inner ends of the control rods 12 (which ends are pivoted onthe slide hinge 13) to be pulled in the direction of the middle hinge 8, whereby an initial folding movement of the outermost blade part 10 occurs, as illustrated in FIG. 2.

During the progressive opening movemnt as soon as the forks 5 approach a right angled or perpendicular position with respect to the middle blade part 7, the shifting movement of the slide hinge 13 in the direction of the middle hinge 8 accelerates. In this manner the folding-down movement of the outermost blade part 10 is intensified or increased so that the outer annular shaped part of the umbrella cover 16 is brought into the correct position, before the umbrella frame assumes its finally opened position in which the umbrella cover 16 is tautly and tightly tensioned. The folding-down movement (which is brought about by positive clamping by means of the control rod 12 and the lever 14) of each outermost blade part 10 thus prevents an unintended folding back of the blade part 10 and consequently an incomplete opening of the umbrella cover 16.

Since the folding-down movement of the outermost blade part 10 is completed before the slider 3 arrives in its upper end position, the remaining movement of the slider 3 causes a setting or deformation of the forks 5, the control rods 12 and/or the middle blade parts 7. By the illustrated embodiment example in accordance with the present invention, the dimensions of these parts are selected such that the middle blade part 7 is outwardly bowed-through or deflected in the sense of the arch or curvature of the umbrella canopy.

In order to close the previously described umrella, it is only simply ncesssary to move the slider 3 (from its uppermost position locked on the outer tube 1*a* of the rod 1) in the direction of the handle 19, since in this manner simultaneously the circularly shaped center piece of the umbrella cover 16 is cooperatively folded up and the outer annular shaped part of the umbrella cover is folded or turned up. The frame thus brings about an closing of the entire umbrella. The three part rod assembly 1 is shortened or collapsed by means of the relative shifting of the tubular formed telescopic parts in one another.

While I have disclosed one embodiment of the present invention, it is to be understood that this embodiment is given by example only and not in a limiting sense.

I CLAIM:

1. A shortenable umbrella having blades carrying the umbrella canopy in opened condition, the blades being shortenable at least by a factor of two by folding, and having a shortenable rod and a crown secured on the shortenable rod and at least one fork operatively connected to a slider displaceably disposed on the shortenable rod for pivoting the blades, comprising an innermost blade part being pivoted on said crown, an outermost blade part having an extension, a middle blade part operatively connected to said innermost and outermost blade parts, respectively, a middle hinge pivotally connecting said middle blade part and said innermost blade part, a control rod operatively connected said extension of said outermost blade part, said outermost blade part being hinged foldably onto said middle blade part by means of said control rod, said control rod having an inner end, said control rod operatively enaging directly and positively without slipping on said outermost blade part, a slide hinge pivotably fastened to said inner end of said control rod, said slide hinge being displaceably disposed on said middle blade part in the vicinity of said middle hinge, a fork operatively connected to the slider and pivotally connected to said middle blade part at a first pivot point, a short connecting rod pivotally connected to said fork at a second pivot point and to said slide hinge, the latter being articulated play-free operatively on said fork by means of said short connecting rod, said short connecting rod being as little as possible longer than the distance between said second pivot point on said fork and said first pivot point of said fork on said middle blade part.

2. The umbrella, as set forth in claim 1, wherein said innermost blade part comprises, a scissors fork pivotally connected between the crown and said first-mentioned fork, a stretch segment fork pivotally connected between said scissors fork and said middle hinge, the latter being secured to an inner end of said middle blade part.

3. The umbrella, as set forth in claim 1, wherein said middle blade part is outwardly bent in a sense of an outward curving of said canopy of the umbrella by a residual movement of the slider after completion of the folding-down movement of said outermost blade part in its upper end position.

* * * * *